United States Patent [19]

Frommherz

[11] 4,225,119

[45] Sep. 30, 1980

[54] CONTINUOUS WINCH

[75] Inventor: Egon Frommherz, Steinen, Fed. Rep. of Germany

[73] Assignee: Rotzler GmbH & Co. Spezialfabrik für Seilwinden und Hebezeuge, Steinen, Fed. Rep. of Germany

[21] Appl. No.: 937,417

[22] Filed: Aug. 28, 1978

[30] Foreign Application Priority Data

Sep. 1, 1977 [DE] Fed. Rep. of Germany ..... 2739423

[51] Int. Cl.[3] ..... B66D 1/76

[52] U.S. Cl. ..... 254/294; 242/54 R; 188/64; 254/375

[58] Field of Search ..... 254/175.5, 175.6, 175.7, 254/150; 226/151; 242/54 R

[56] References Cited

U.S. PATENT DOCUMENTS

| | | | |
|---|---|---|---|
| 3,666,239 | 5/1972 | Koshihara | 254/175.5 |
| 3,680,839 | 8/1972 | Mattinson | 254/175.5 |
| 3,717,325 | 2/1973 | Peterson | 254/175.7 |
| 3,776,519 | 12/1973 | Hamilton | 254/175.7 |

*Primary Examiner*—Edward J. McCarthy

*Attorney, Agent, or Firm*—Becker & Becker, Inc.

[57] ABSTRACT

A continuous winch with two wheels of which at least one is driven and in case of a multi-groove design is provided with a run-off groove for the non-loaded cable section, while the unloaded run-off cable section in the run-off groove is adapted to be clamped or guyed transverse to the running off direction. The run-off groove is on one side confined by a clamping wheel which is spring loaded in clamping direction substantially merely on that semi-arc which is looped around by the running-off cable.

10 Claims, 3 Drawing Figures

CONTINUOUS WINCH

The present invention relates to a continuous winch (Durchlaufwinde) with two pulleys of which at least one is driven and, if a multi-groove design is involved, is provided with a run-off groove for the cable which is not under load, while the run-off cable in the run-off groove is adapted to be guyed or tensioned in a direction transverse to the run-off direction, and the runoff groove is spring-loaded by a tightening disc which is spring-loaded in tightening direction.

With a heretofore known winch of the above mentioned type, the tightening or clamping disc is preloaded by a centrally arranged spring leaf packet and thus, with regard to the spring preload, is practically uniformly loaded over its entire circumference. The run-off cable which is guided in the run-off groove is looped around the corresponding disc, but only over a region of about 180°. Consequently, the counter force acting counter to the pressing force of the spring is built up substantially only over an arc of about 180° so that a relatively exact guiding for the clamping disc has to be provided if a canting or tilting is to be avoided whereby the necessary frictional effect relative to the cable would not be assured.

It is therefore an object of the present invention to provide a continuous winch which will present the above outlined drawbacks.

This object and other objects and advantages of the invention will appear more clearly from the following specification in connection with the accompanying drawings, in which.

Figure 1:
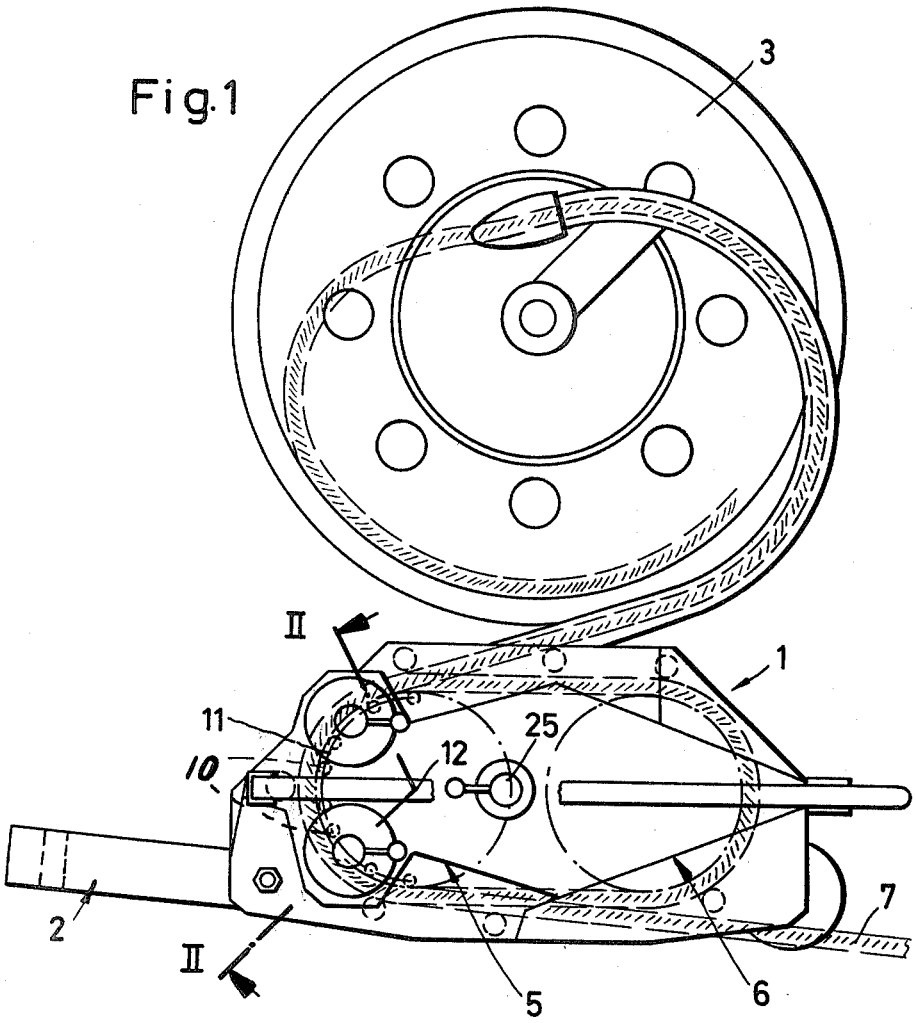
FIG. 1 represents a diagrammatic overall illustration of a winch according to the present invention.

The winch according to the present invention is characterized primarily in that the clamping disc is spring-loaded over its semi-arc looped around by the running-off cable. As a result thereof, the spring-tension is applied precisely over only that region in which, by means of the cable lying in a run-off groove, a corresponding counter holding force can be built up. Canting or tilting of the clamping disc and non-uniformity inherent thereto are therefore excluded in the frictional effect exerted upon the cable.

According to a further development of the invention, it has proved advantageous to provide a plurality of pressure springs acting upon the clamping disc, and to provide the pressure springs above the semi-arc which is looped around by the run-off cable. These pressure springs may preferably be formed by a packet of dish springs which are arranged between a lateral closing-off plate of the winch and the clamping disc. With such a design, the magnitude of the pressing force exerted by the springs upon the clamping disc is structurally defined and predetermined. Faulty adjustments will thus be avoided.

According to a further development of the invention, the clamping disc is adapted to be lifted against the spring load by means of lifting devices which are associated substantially only with the spring-loaded semi-arc. As lifting devices in this connection there are preferably employed in the semi-arc two lifting elements which are arranged substantially symmetrically with regard to the dividing plane of the spring-loaded semi-arc. Preferably, within the framework of the present invention, one lifting element each is located on the angle bisector of the quarter arcs associated with the spring-loaded semi-arc. Preferably, the radial distance of the axis of the lifting elements from the axis of rotation of the clamping disc corresponds to the radial distance of the leaf spring packet from this axis of rotation so that the lifting elements, in circumferential direction, are located between two spring packets following each other in circumferential direction.

For purposes of stabilization, according to a further development of the invention, a third lifting element may be provided expediently in the dividing plane of the non-spring loaded semi-arc so that a total of three lifting elements is provided which are arranged at the tips of an isosceles triangle. The lifting element which is associated with the non-spring loaded semi-arc may preferably be made weaker than the two other lifting elements.

As lifting elements within the framework of the invention preferably hydraulically operated cylinder piston systems are employed the piston rods of which are operatively connected to the clamping disc, while the piston part is guided in an outwardly located cylinder bore of the above mentioned closing-off plate.

Instead of such hydraulic lifting elements, which have the advantage that they can also be operated in not easily accessible areas and by means of which also a uniform lifting of the clamping disc is assured in a simple manner, also mechanical lifting elements may be used, such as lifting spindles.

Referring now to the drawings in detail, the winch generally designated with the reference numeral 1 is adapted by means of a suspension 2 to be mounted, for instance, on a vehicle, especially a trailer coupling of the vehicle, while above the suspension there is arranged the cable drum 3 preferably as a structural unit with the winch.

The winch 1 comprises two wheels 5 and 6 adapted to be driven by means of a hydraulic motor 4 and respectively provided with a plurality of grooves. The wheels 5 and 6 are looped around a plurality of times by the cable 7 which is passed from the wheels to the cable drum 3.

Figure 3:
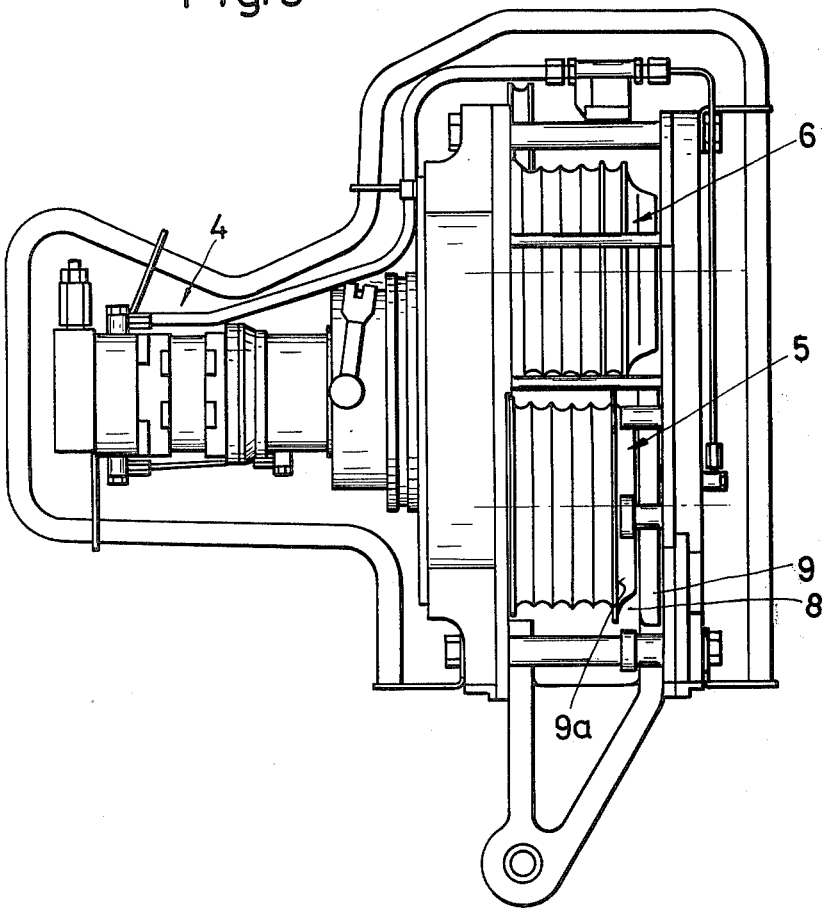
FIG. 3 is a top view of the winch according to the invention as illustrated in FIG. 1 but without the cable drum of FIG. 1.

Of these wheels 5, 6, the wheel 5 is provided with a run-off groove 8 by means of which the cable 7 is passed to the cable drum 3. This run-off groove 8 is on one side confined by a clamping disc 9 which is spring-urged or spring-loaded in the direction toward the oppositely located groove side 9*a* (FIG. 3). As a result thereof, the cable in the run-off groove 8, with regard to the axis of rotation of the clamping wheel 5, is held axially clamped so that, when the wheel 5 is driven, the cable will due to the axial clamping thereof be taken along via the clamping disc 9. As a result thereof, without any manual actuation of the cable, the latter can be preloaded relative to the suspended load to such a degree that the necessary frictional connection is established between the cable and the wheels looped around by the cable.

Figure 2:
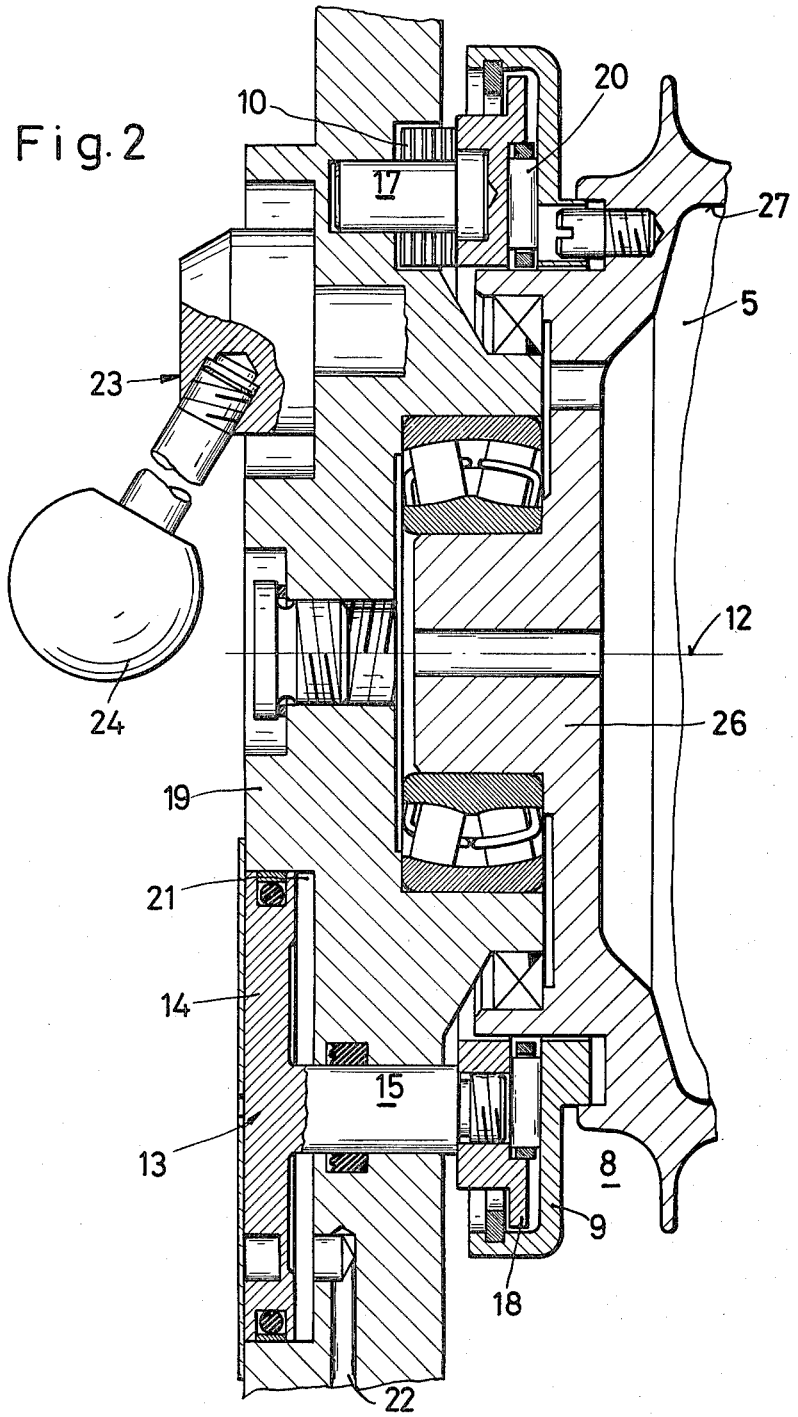
FIG. 2 illustrates on a scale enlarged over that of FIG. 1 a section taken along the line II—II of FIG. 1.

As will be evident from FIGS. 1 and 2, the clamping disc 9 is placed under load by leaf spring packets 10 of which, in the specific embodiment shown in the drawings, eight packets are arranged in spaced relationship to each other over the semi-arc 11 looped around by the running off cable. The leaf spring packets 10 have an equal radial spacing with regard to the axis of rotation of the wheel 5 which surrounds the clamping disc 9. Between two successive leaf spring packets 10 and at the same radial distance with regard to the axis 12, there are provided two actuating elements 13 which are operable hydraulically and which comprise a piston 14 and a piston rod 15. The piston rod 15 as well as the leaf spring packets 10 which are arranged on guiding bolts 17 act upon a clamping ring 18. The clamping ring 18 is non-rotatably supported relative to the lateral closure plate 19 of the winch and rests axially through antifriction bearings 20 on the clamping disc 9. The pistons 14 are located in outside bores 21 of the closure plate 19. These bores 21 are adapted through supply bores 22 to be acted upon by oil under pressure. When oil under pressure is conveyed to the bores 21, the pistons 14 are urged outwardly with the result that by means of the piston rods 15 the clamping ring 18 is taken along against the thrust of the leaf spring packets 10. The clamping disc 9 is then axially displaced so that the running off cable can freely be pulled through or can be placed into the winch or can be removed therefrom.

Instead of a hydraulic actuation as indicated in FIG. 2, also a mechanical actuation is possible and, more specifically, by means of a non-illustrated clamping structure, according to which a lifting-off spindle engaging the clamping ring 18 and preferably threadedly guided in a closure plate 19, is by means of a control lever 24 adjustable in such a way that the clamping ring 18 can be lifted off from the clamping disc 9. In FIG. 2 the clamping structure 23 is merely indicated and is also shown offset.

In addition to the above mentioned lifting off elements 13 associated with with the spring-loaded semi arc, as shown in FIG. 1, according to a further development of the invention, there is preferably provided a further lifting-off element 25 which may likewise be mechanically or hydraulically operated and which expediently is located opposite the lifting-off elements 13 while engaging the clamping ring 18. Preferably, this additional third lifting-off element is located in the dividing plane of the nonspring loaded semi-arc so that the lifting-off elements 13 and 25 are located at the corners of an isosceles triangle.

As will be evident from FIG. 2, with the design according to the present invention the multi-groove wheels, as illustrated in connection with wheel 5, are designed as self-supporting units. As self-supporting units, the wheels 4, 5 are journalled directly in the lateral closure plates, while the wheel 5 is provided with a trunion 26 by means of which it engages a corresponding bore of the closure plate 19. The oppositely located non-illustrated closure plate is in its turn provided with a trunion-shaped extension which carries the bearing on which the multi-groove wheel 5 rests by its inner mantle 27. In this way a separate supporting axle for the cable wheels is eliminated resulting in an extremely light construction as it is desirable with regard to the handling of the winch according to the invention.

It is of course to be understood that the present invention is, in no way, limited to the specific showing in the drawings but also encompasses any modifications within the scope of the appended claims.

What I claim is:

1. A continuous winch, which includes: two wheels at least one of which is adapted to be driven and provided with a run-off groove for the non-loaded cable section and having a semi-arc of said wheels to be looped around by a running-off cable, and clamping means associated with said run-off groove for clamping the cable section in the run-off groove in a direction transverse to the running off direction of said cable section, said clamping means comprising a clamping wheel forming one lateral and movable confining wall of said run-off groove and being spring-loaded in clamping direction substantially merely on that semi-arc of said wheel which is to be looped around by the running off cable.

2. A winch according to claim 1, which includes a plurality of compression springs spring loading said clamping wheel, said compression springs being arranged within the region of and along said semi-arc.

3. A winch according to claim 2, in which said compression springs include packets of dish springs.

4. A winch according to claim 3, which includes a lateral closure plate, and in which said packets of dish springs are arranged between said closure plate and said clamping wheel.

5. A winch according to claim 1, in which said clamping means include actuating means associated with said semi-arc for moving said clamping wheel against the thrust of said compression springs.

6. A winch according to claim 5, in which said actuating means comprises two stroke performing members arranged substantially symmetrically with regard to the dividing plane of said semi-arc.

7. A winch according to claim 6, which includes: a third stroke performing member arranged in spaced relationship and opposite to said semi-arc while being located substantially in the plane of symmetry of the latter.

8. A winch according to claim 5, in which said actuating means include hydraulically operable cylinder-piston units.

9. A winch according to claim 5, in which said actuating means include mechanically operable units.

10. A winch according to claim 9, in which said actuating means include spindle means.

* * * * *